US007448970B2

(12) United States Patent
Li

(10) Patent No.: US 7,448,970 B2
(45) Date of Patent: Nov. 11, 2008

(54) HEIGHT ADJUSTING DEVICE FOR USE IN STRING PULLER OF STRING PULLING BLOCK OF STRINGING MACHINE

(75) Inventor: Tsai-Tien Li, Kaohsiung (TW)

(73) Assignees: Chun-Chieh Li, Kaosiung (TW); Po-Hsiu Li, Tapei (TW)

( * ) Notice: Subject to any disclaimer, the term of this patent is extended or adjusted under 35 U.S.C. 154(b) by 0 days.

(21) Appl. No.: 11/845,933

(22) Filed: Aug. 28, 2007

(65) Prior Publication Data

US 2008/0242454 A1 Oct. 2, 2008

(30) Foreign Application Priority Data

Mar. 30, 2007 (TW) ..... 96111259 A

(51) Int. Cl.
*A63B 51/14* (2006.01)

(52) U.S. Cl. ..... 473/557

(58) Field of Classification Search ..... 473/555–557
See application file for complete search history.

(56) References Cited

U.S. PATENT DOCUMENTS 4,249,732 A * 2/1981 Balaban ..... 473/556
4,326,713 A * 4/1982 Balaban ..... 473/556
4,417,729 A * 11/1983 Morrone ..... 473/556
5,568,921 A * 10/1996 Lorentzen et al. ..... 473/556
5,908,362 A * 6/1999 Carr ..... 473/557
6,984,185 B2 * 1/2006 Nakane et al. ..... 473/556
7,144,342 B1 * 12/2006 Van Der Pols ..... 473/557
2005/0096160 A1 * 5/2005 Nakane et al. ..... 473/557

* cited by examiner

*Primary Examiner*—Raleigh W. Chiu
(74) *Attorney, Agent, or Firm*—Alan Kamrath; Kamrath & Associates PA

(57) ABSTRACT

A height adjusting device for a string puller of a string pulling block of a stringing machine includes a rod member. The string pulling block is allowed to move relative to the rod member and includes the string puller and a lever disposed thereon. The string pulling block includes an upper support provided therein and having a tilted slidable mount disposed thereon. The string pulling block further includes a lower support mounted on the rod member and having a tilted coupling seat affixed thereon. The coupling seat is obliquely coupled with the lower support and involves an inclined rail arranged thereon for axially moving a sliding member therein. By attaching the coupling seat onto the sliding member, the upper support may obliquely move upward and downward along the rail, thus adjusting the height of the string puller.

6 Claims, 9 Drawing Sheets

HEIGHT ADJUSTING DEVICE FOR USE IN STRING PULLER OF STRING PULLING BLOCK OF STRINGING MACHINE

BACKGROUND OF THE INVENTION

1. Field of the Invention

The present invention relates to a height adjusting device for use in a string puller of a string pulling block of a stringing machine that may improve the stringing quality and facilitate the height adjustment of the string pulling block.

2. Description of the Prior Arts

Tennis and badminton are both healthy and intellectual sports. To develop the skill of playing tennis or badminton, a racket and strings with a precise pound number are both indispensable winning factors in a tennis or badminton game. Besides, the stringing method of the racket also influences the service lives of the racket and strings.

A prior art stringing machine comprises a base a, a holder b and a string pulling block c (as shown in FIG. 1). The holder b is axially connected to the top of the base a for 360 degree rotation and positioning. The string pulling block c includes a string puller c1 and a lever c2 both arranged thereon. A rod member 10 for combining with the sting pulling block c is coupled onto the upper side of the base a (as illustrated in FIG. 2) and includes racks 101 arranged thereon, such that the string pulling block c may move along the racks 101. In other words, the string pulling block c may move relative to the rod member 10.

In operation, the frame d is supported by the holder b, and the string e is fixed between the string puller c1 of the string pulling block c and the frame d (as shown in FIG. 2). Thereafter, the pound number of the string e is set. By rotating the lever c2, the set pound number of the string e is achieved, thereby assembling the longitudinal and lateral strings e of the frame d in turns.

However, such a prior art stringing machine still has the following defects:

1. Easily harming the frame d and the string e: Since the various kinds of frames d are not provided with the same thickness and the heights of the holders b and the string pulling blocks c are fixed, inserting the string e between the string puller c1 of the string pulling block c and the frame d causes an included angle θ therebetween (as illustrated in FIG. 2). Hence, when pulling the string e, the force of the frame d is unequal because of friction, obtaining an imprecise pound number. Furthermore, the string e or the frame d is easily broken because of friction between the through holes formed in the frame d and the string e.

2. Disadvantageous operation: Since the various kinds of frames d are not provided with the same thickness and the heights of the holders b and the string pulling blocks c are fixed, during the rotation of the frame d, a grip d1 of the frame d contacts with the string puller c1 (as illustrated in FIGS. 3 and 4), resulting in an disadvantageous operation.

The present invention has arisen to mitigate and/or obviate the afore-described disadvantages.

SUMMARY OF THE INVENTION

The primary object of the present invention is to provide a height adjusting device for use in a string puller of a string pulling block of a stringing machine that may protect strings and a frame from harm.

Another object of the present invention is to provide a height adjusting device for use in a string puller of a string pulling block of a stringing machine that may avoid contact of the frame and the string puller during the rotation of the frame.

In accordance with one aspect of the present invention, a height adjusting device is provided for use in a string puller of a string pulling block of a stringing machine including a base, a frame, and a rod member. The rod member includes racks provided thereon. The string pulling block has a gear meshed on the upper side of the rod member such that the string pulling block mounted on the rod member may be meshed with the racks by way of the gear and moved along the racks. The string pulling block contains the string puller and a lever disposed thereon.

The string pulling block has an upper support provided therein and having a tilted slidable mount disposed thereon. The string pulling block further includes a lower support mounted on the rod member and having a tilted coupling seat affixed thereon. The string puller is fixed on the upper support.

The slidable mount is obliquely connected with the upper support and involves abutting portions formed on two sides thereof.

The coupling seat is obliquely coupled with the lower support and involves an inclined rail arranged thereon for axially moving a sliding member therein. By attaching the coupling seat onto the sliding member, the upper support may obliquely move upward and downward along the rail, thus adjusting the height of the string puller. The coupling seat further includes two side plates in response to each other secured at two sides thereof for receiving the rail therein, with the slidable mount being slidable between the two side plates. Also, one of the side plates includes a micro-adjustable screw screwed thereon, and another of the side plates includes an adjusting screw screwed thereon. The micro-adjustable screw and the adjusting screw are in response to the abutting portions of the slidable mount respectively.

In assembly, a frame is supported by the holder, and a string is fixed between a string puller of the string pulling block and the frame. Thereafter, the pound number of the string is set. Since the string is in an extension state, the slidable mount of the upper support obliquely moves upward relative to the inclined rail of the string pulling block, thereby the string inserted between the frame and the string puller is almost in a horizontal state. One of the abutting portions is biased against the micro-adjustable screw of the coupling seat. Then, the micro-adjustable screw is rotated for a micro adjustment to let the string become horizontal. Since the micro-adjustable screw abuts against the abutting portion and during the string pulling process, the string will be kept in a horizontal state. Finally, by rotating the lever, the gear urges the string pulling block to cause an upper movement on the rack. Thus, the set pound number of the string is obtained, assembling the longitudinal and lateral strings of the frame in turns.

If turning the frame for stringing results in the string outside the frame becoming loose, the slidable mount obliquely and downwardly moves toward another abutting portion which is biased against the adjusting screw of the coupling seat. To avoid a grip contacting with the string puller of the string pulling block during the rotation of the frame, the adjusting screw is rotated. Simultaneously, the heights of the slidable mount, the upper support and the string puller are descended without causing the grip to contact with the string puller, facilitating rotation in different directions.

The present invention will become more obvious from the following description when taken in connection with the accompanying drawings, which show, for purpose of illustration only, the preferred embodiment in accordance with the present invention.

DETAILED DESCRIPTION OF THE PREFERRED EMBODIMENT

Figure 1:
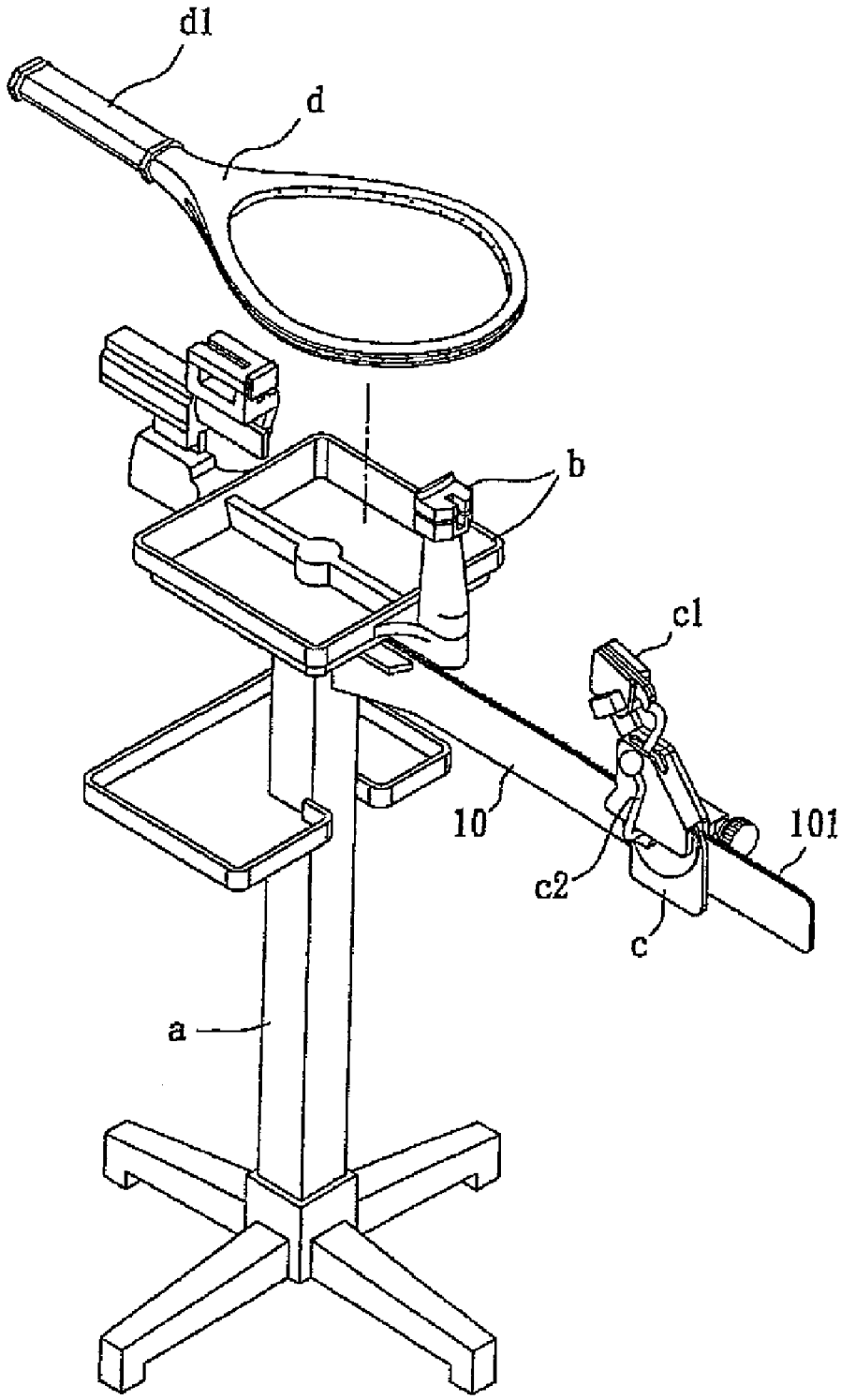
FIG. 1 PRIOR ART
FIG. 1 is a perspective diagram illustrating the exploded components of a prior art stringing machine.
Figure 2:
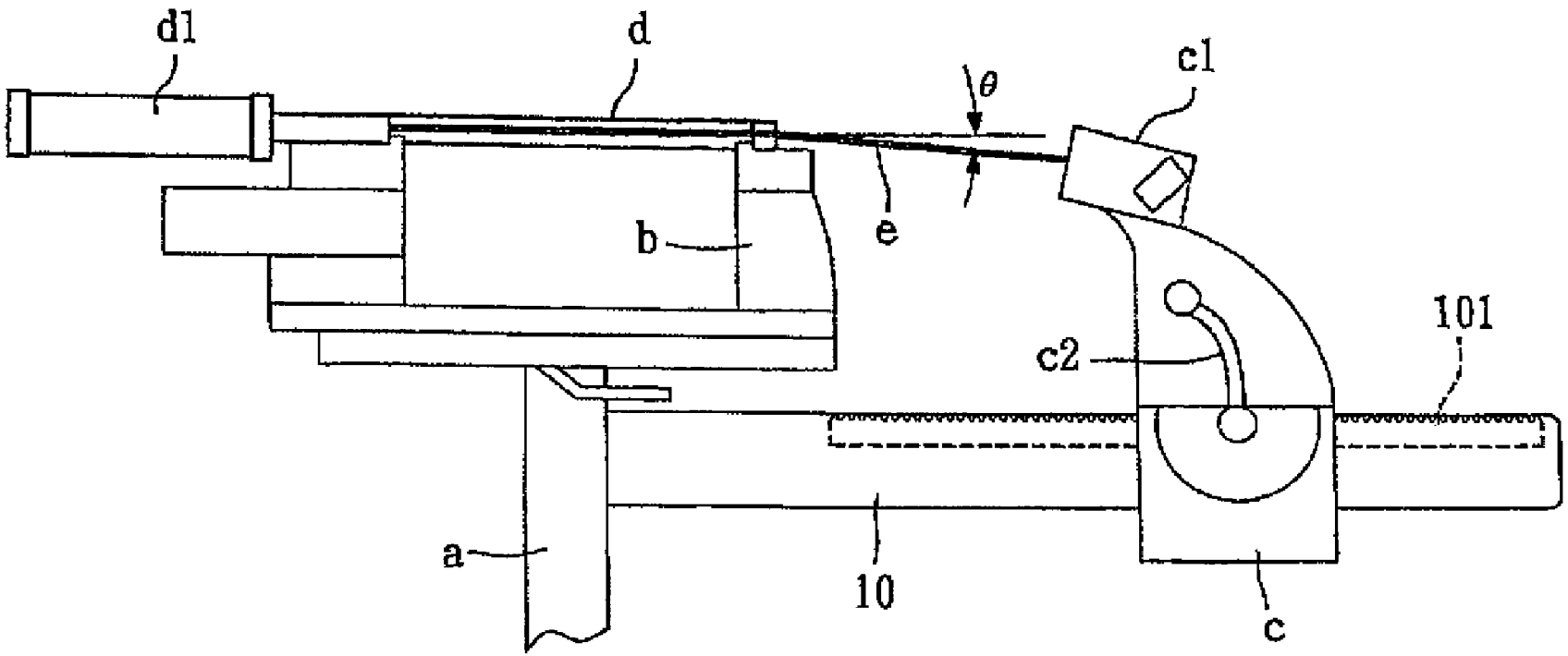
FIG. 2 PRIOR ART
FIG. 2 is a side diagram illustrating an angle occurring between a frame of the prior art stringing machine and a string.
Figure 3:
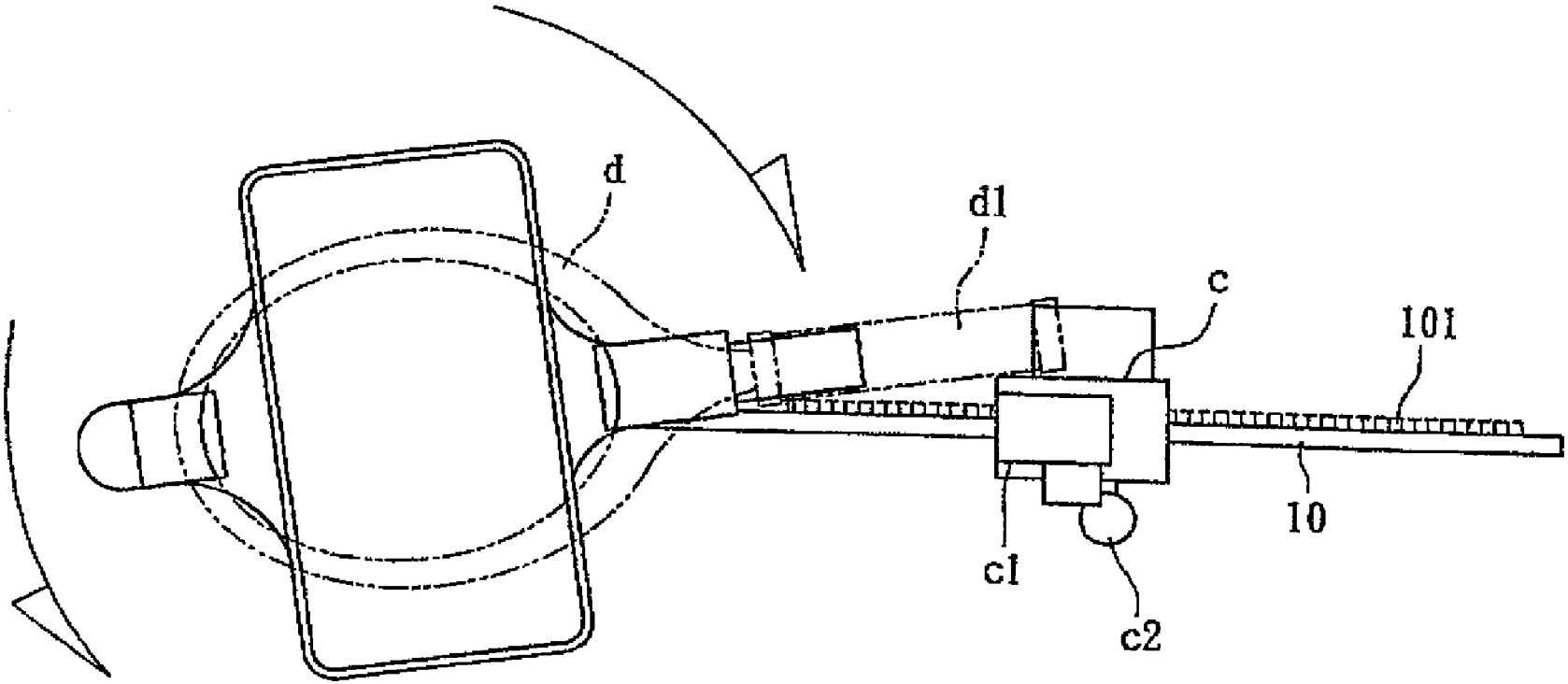
FIG. 3 PRIOR ART
FIG. 3 is a top plane diagram illustrating a grip contacting with a string puller of a string pulling block after rotation of the frame of the prior art stringing machine.
Figure 4:
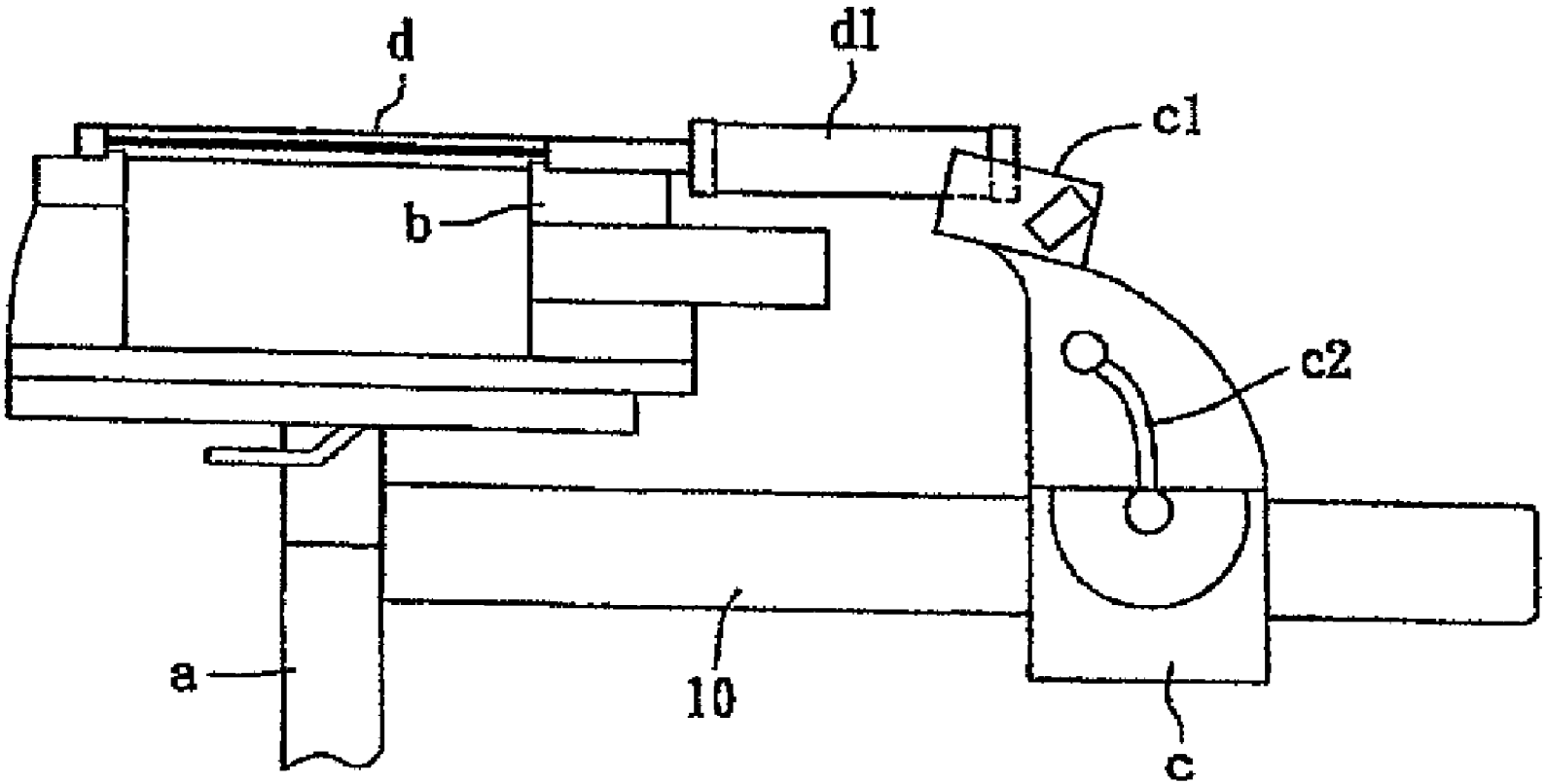
FIG. 4 PRIOR ART
FIG. 4 is a side diagram according to FIG. 3.
Figure 5:
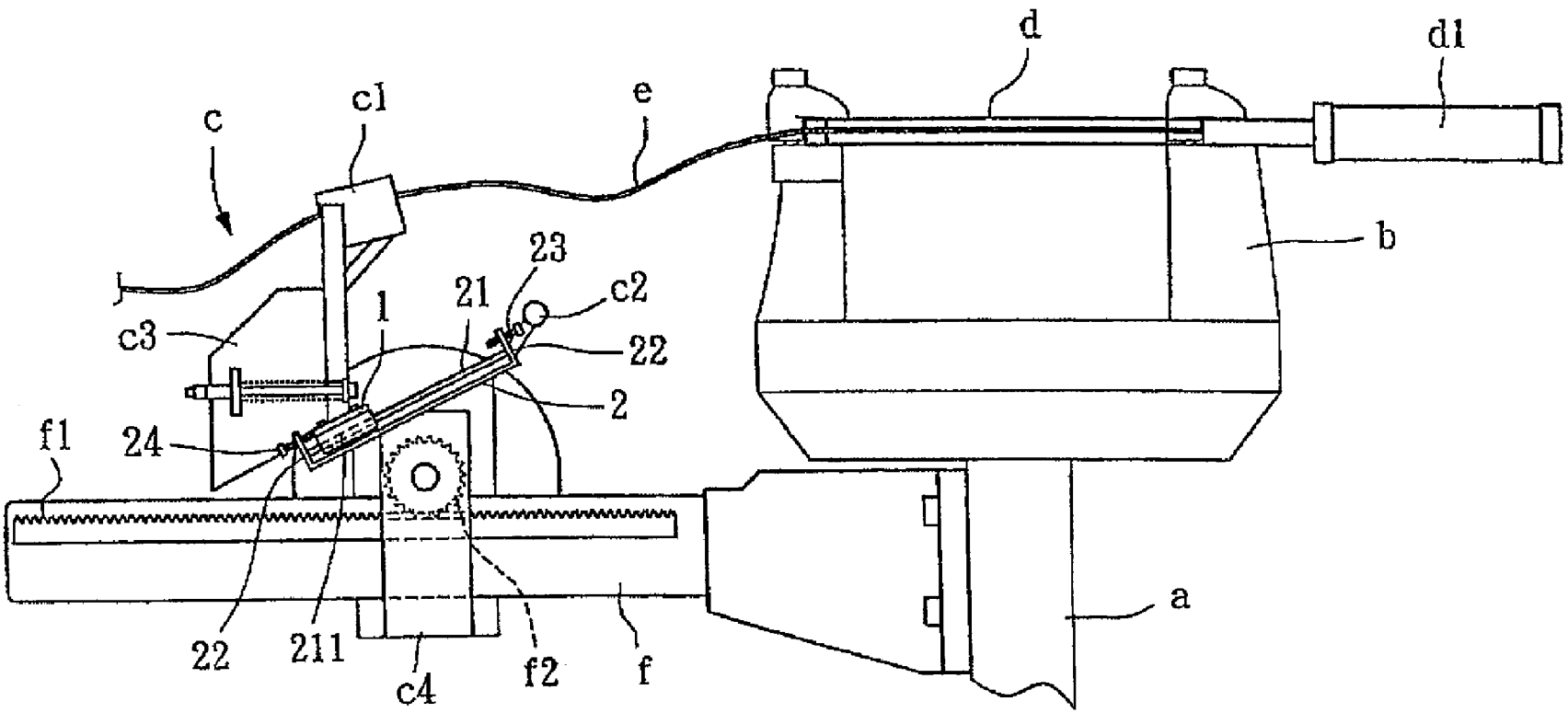
FIG. 5 is an assembly side diagram of a height adjusting device for use in a string puller of a string pulling block of a stringing machine according to the present invention.

Referring to FIG. 5, a height adjusting device for use in a string puller of a string pulling block of a stringing machine in accordance with the present invention comprises a base a, a holder b, a string pulling block c and a rod member f. The rod member f includes racks f1 provided thereon. A gear f2 rotatably mounted in a lower support r4 is meshed on the upper side of the rod member f. The string pulling block c mounted on the rod member f may be meshed with the racks f1 by way of the gear f2 and moved along the racks f1. The string pulling block c contains a string puller c1 and a lever c2 disposed thereon (as illustrated in FIG. 6).

Figure 6:
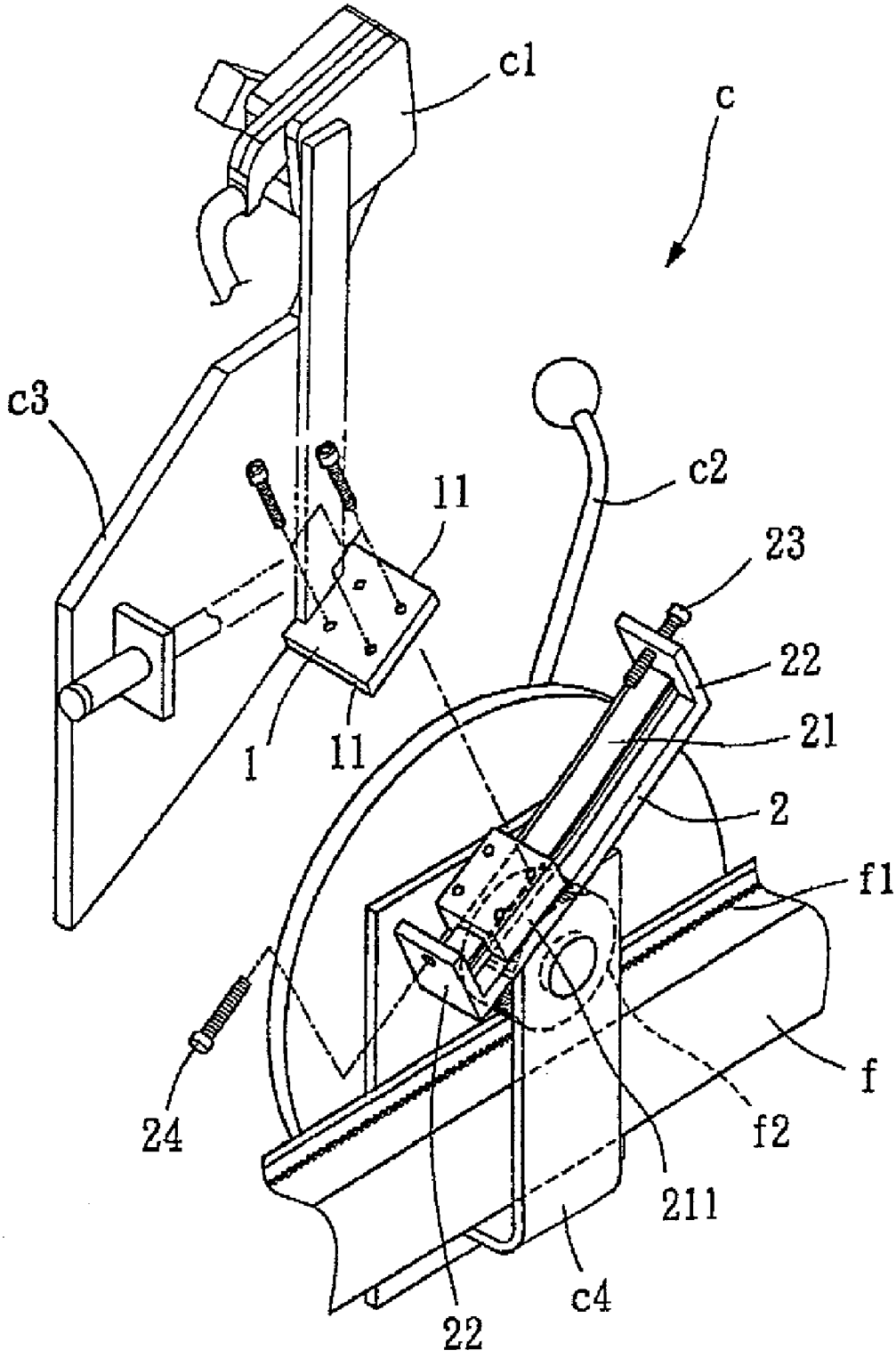
FIG. 6 is a perspective diagram illustrating the exploded components of the height adjusting device for use in a string puller of a string pulling block of a stringing machine according to the present invention.

The string pulling block c has an upper support c3 provided therein having a tilted slidable mount 1 disposed thereon (as shown in FIG. 6). The string sliding block e includes the lower support c4 mounted on the rod member f and having a tilted coupling seat 2 affixed thereon. The upper support c3 has the string puller c1 connected thereon. Also, the string puller c1 is fixed on the upper support c3.

The slidable mount 1 is obliquely connected with the upper support c3 and involves abutting portions 11 formed on two sides thereof.

Figure 7:
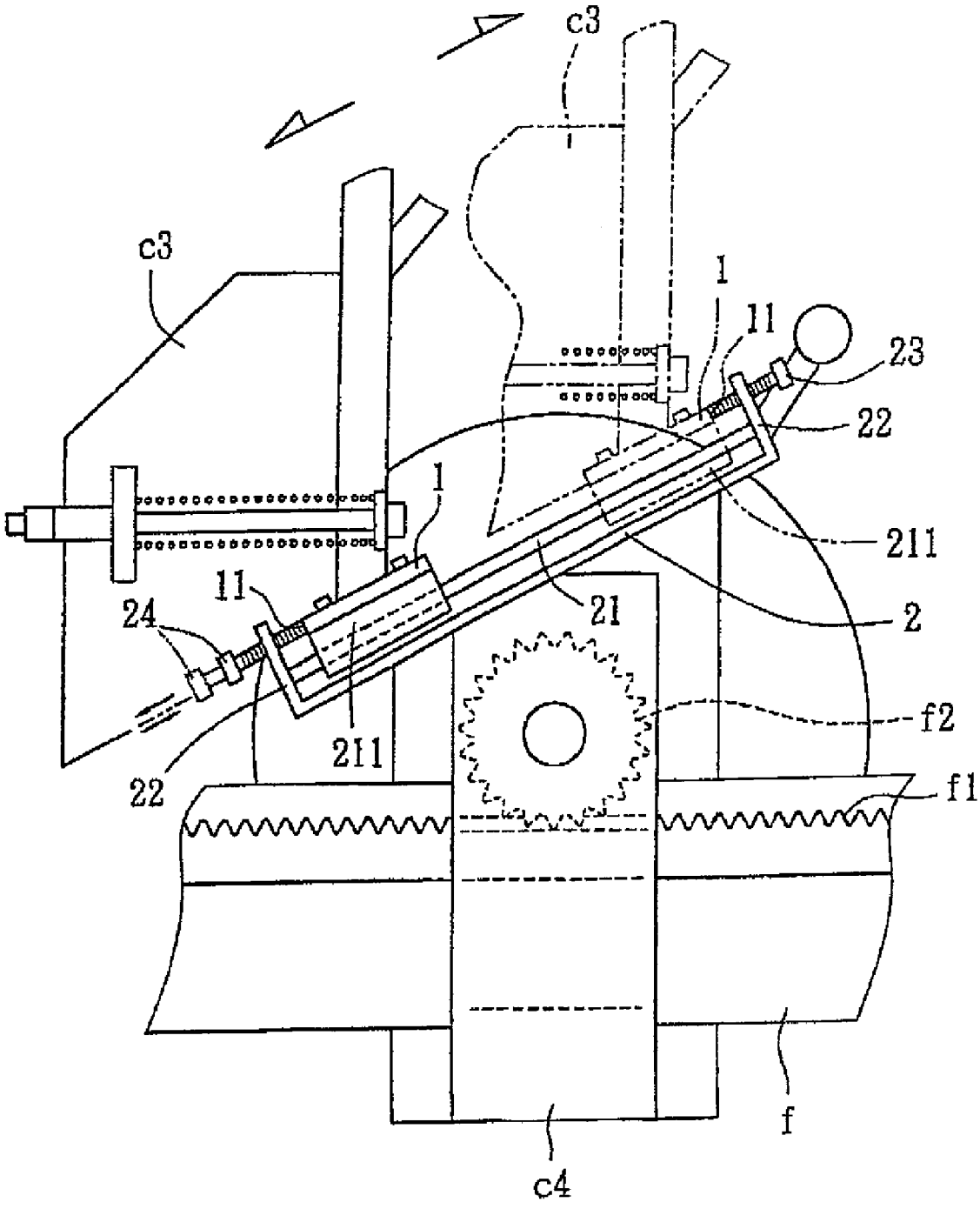
FIG. 7 is an operational side diagram of the height adjusting device for use in a string puller of a string pulling block of a stringing machine according to the present invention.

The coupling seat 2 (as shown in FIGS. 5 and 6) is obliquely coupled with the lower support c4 and involves an inclined rail 21 arranged thereon for axially moving a sliding member 211 therein. By attaching the slidable mount 1 onto the sliding member 211 for connecting with the inclined rail 21, the upper support c3 may obliquely move upward and downward along the inclined rail 21 (as illustrated in FIG. 7), thus adjusting the height of the string puller c1. The coupling seat 2 further includes two side plates 22 in response to each other secured at two sides thereof for receiving the inclined rail 21 therein, with the slidable mount 1 slidable between the two side plates 22 thereof. Besides, one of the side plates 22 includes a micro-adjustable screw 23 screwed thereon, and another of the side plates 22 includes an adjusting screw 24 screwed thereon. The micro-adjustable screw 23 and the adjusting screw 24 are in response to the abutting portions 11 of the slidable mount 1 respectively (as shown in FIG. 7).

Figure 8:
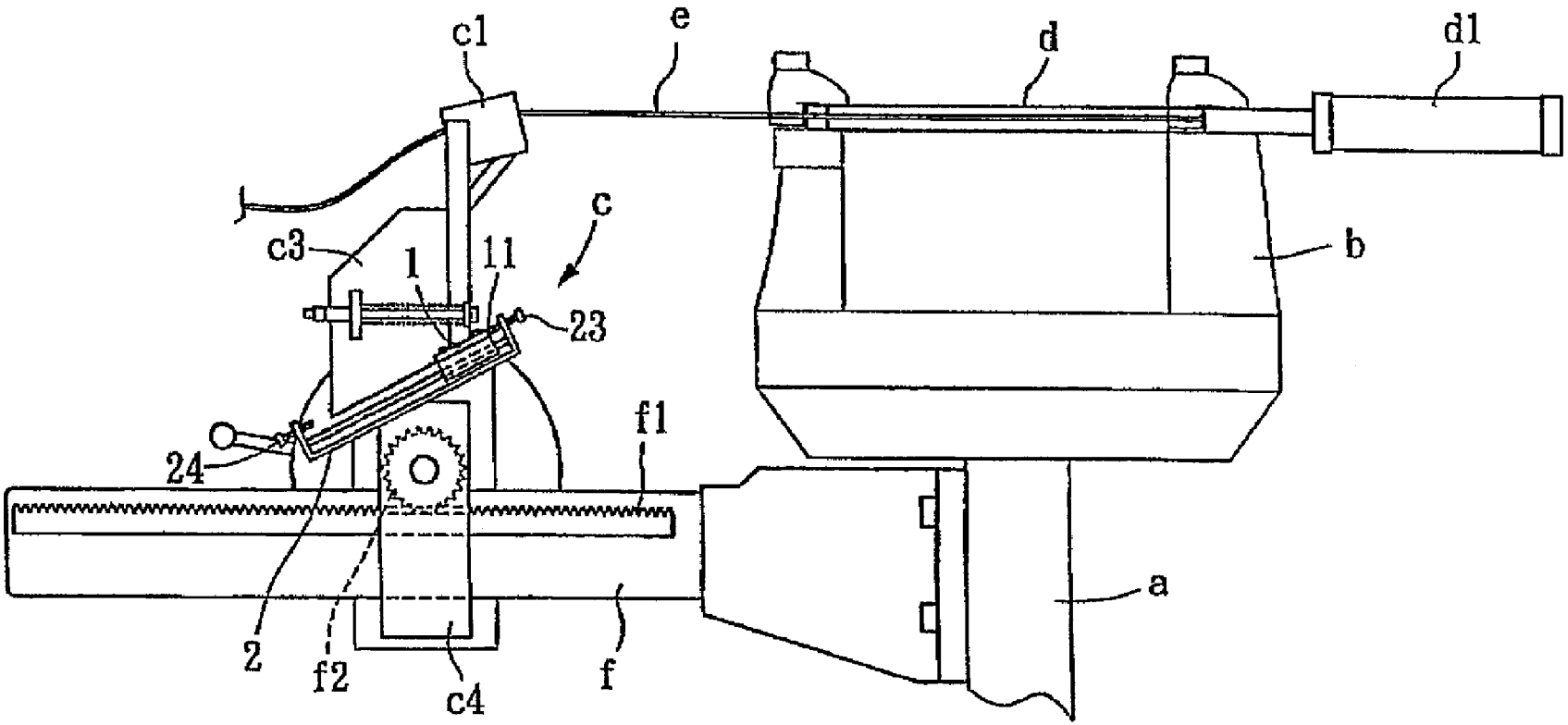
FIG. 8 is an operational side diagram illustrating a string puller of the present invention being moved upward.

In assembly, a frame d is supported on the holder b, and a string e is fixed between a string puller c1 of the string pulling block c and the frame d (as shown in FIG. 8). Thereafter, the pound number of the string e is set. Since the string e is in an extension state, the slidable mount 1 of the upper support c3 obliquely moves upward relative to the inclined rail 21 of the string pulling block c, thereby the string e inserted between the frame d and the string puller c1 is almost in a horizontal state. One of the abutting portions 11 is biased against the micro-adjustable screw 23 of the coupling seat 2. Then, the micro-adjustable screw 23 is rotated for a micro adjustment to let the string e become horizontal. Since the micro-adjustable screw 23 abuts against the abutting portion 11 and during the string pulling process, the string e will be kept in a horizontal state. Finally, by rotating the lever c2, the gear f2 urges the string pulling block c to cause an upper movement on the rack f1. Thus, the set pound number of the string e is obtained, assembling the longitudinal and lateral strings of the frame d in turns.

Figure 9:
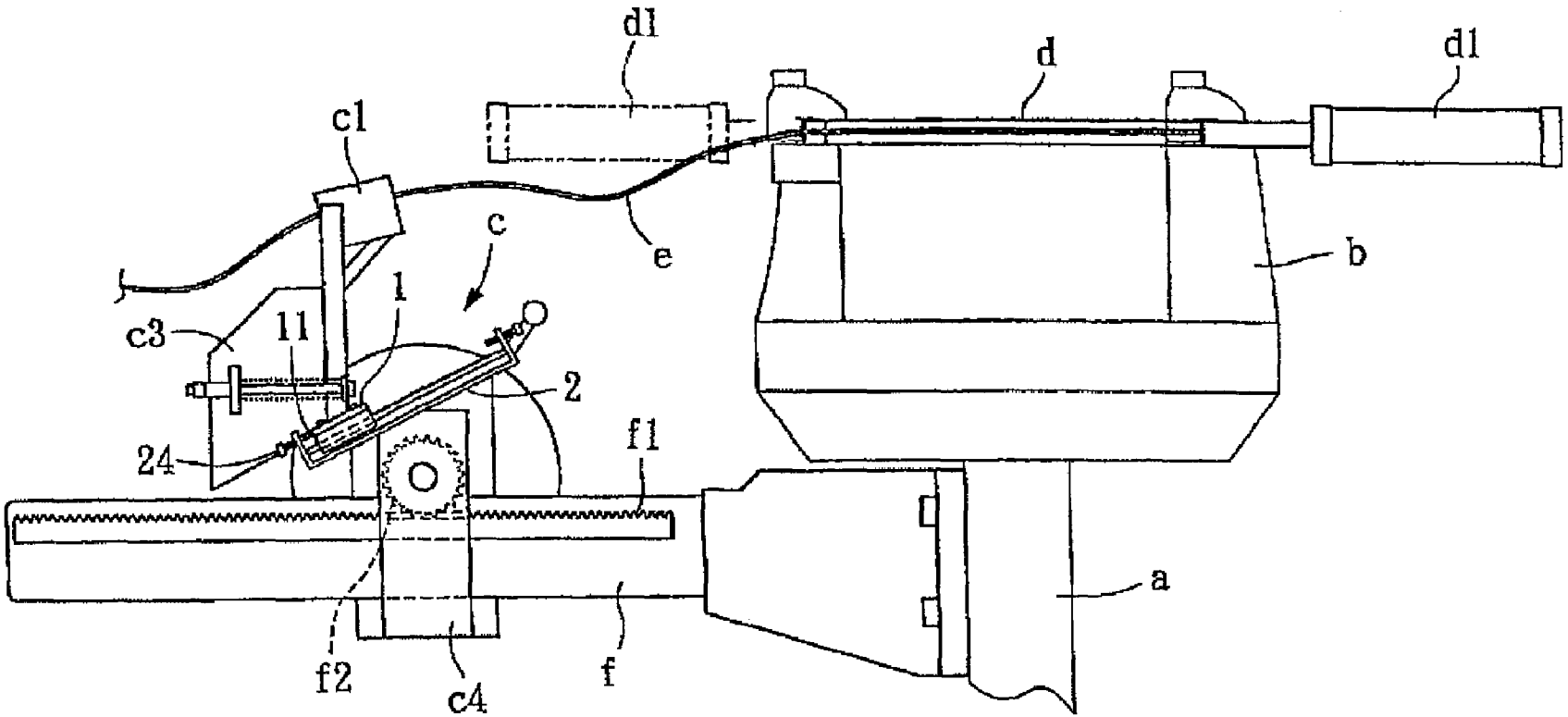
FIG. 9 is an operational side diagram illustrating the string puller of the present invention being moved downward.

If turning the frame d for stringing results in the string e outside the frame d becoming loose, the slidable mount 1 obliquely and downwardly moves toward another abutting portion 11 which is biased against the adjusting screw 24 of the coupling seat 2 (as shown in FIG. 9). To avoid a grip d1 contacting with the string puller c1 of the string pulling block c during the rotation of the frame d, the adjusting screw 24 is rotated. Simultaneously, the heights of the slidable mount 1, upper support c3 and the string puller c1 are descended without causing the grip d1 to contact with the string puller c1, facilitating rotation in different directions.

It can be clearly seen from the preceding accounts on the features of the present invention that the height adjusting device for use in a string pulling block of a stringing machine of the present invention has the following advantages:

1. Protecting the string C and the frame d from harm: Since the heights of the upper support c3 and the string puller c1 may be adjustable to move at different heights relative to the frame d, the string e inserted between the frame d and the string puller c1 is in a horizontal state. In other words, no angle occurs between the frame d and the string e, thus avoiding contact of the string e and the through holes formed in the frame d and friction of the frame d and string e.

2. Avoiding contact of the frame d and the string puller c1 during the rotation of the frame d: By rotating the adjusting screw 24 backward, the heights of the slidable mount 1, the upper support c3 and the string puller c1 may be further descended, and the grip d1 doesn't contact with the string puller c1 of the string pulling block c, facilitating rotation in different directions.

On the other hand, the movement of the string puller c 1 and micro adjustments of the slidable mount 1 may be achieved by an electronic controlling system, causing a precise position.

The invention is not limited to the above embodiment but various modifications thereof may be made. It will be understood by those skilled in the art that various changes in form and detail may made without departing from the scope and spirit of the present invention.

What is claimed is:

1. A height adjusting for use in a stringing machine comprising:

a rod member for connecting with a string pulling block movable relative to said rod member; a string puller and a lever disposed on the string pulling block, wherein said string pulling block has an upper support provided therein, with the upper support having a tilted slidable mount disposed thereon, where the string pulling block further includes a lower support mounted on said rod member, with the lower support having a tilted coupling seat affixed thereon, with the upper support connecting with said string puller, wherein said tilted coupling seat is obliquely coupled with said lower support and involves an inclined rail arranged thereon for axially moving a sliding member therein, with said tilted coupling seat attached onto said sliding member, said upper support obliquely moving upward and downward along said rail, thus adjusting the height of said string puller.

2. The height adjusting device for use in a stringing machine as claimed in claim 1, wherein said tilted slidable mount slides along said rail.

3. The height adjusting device for use in a stringing machine as claimed in claim 2, wherein said tilted slidable mount is obliquely connected with said upper support.

4. The height adjusting device for use in a stringing machine as claimed in claim 1, wherein said tilted coupling seat includes two side plates in response to each other secured at two sides thereof for receiving said rail therein.

5. The height adjusting device for use in a stringing machine as claimed in claim 4, wherein one of said side plates contains a micro-adjustable screw screwed therein, and another of said side plates involves an adjusting screw screwed therein.

6. The height adjusting device for use in a stringing machine as claimed in claim 5, wherein said tilted slidable mount involves abutting portions formed on two sides thereof for corresponding to the micro-adjustable screw and the adjusting screw individually.

* * * * *